US007787595B2

(12) United States Patent
Fritzler et al.

(10) Patent No.: US 7,787,595 B2
(45) Date of Patent: Aug. 31, 2010

(54) ELECTRON SOURCE

(75) Inventors: Sven Fritzler, Erlangen (DE); Peter Schardt, Aisch (DE); Frank Sprenger, Cary, NC (US)

(73) Assignee: Siemens Aktiengesellschaft, Munich (DE)

( * ) Notice: Subject to any disclaimer, the term of this patent is extended or adjusted under 35 U.S.C. 154(b) by 14 days.

(21) Appl. No.: 12/203,181

(22) Filed: Sep. 3, 2008

(65) Prior Publication Data

US 2009/0060137 A1 Mar. 5, 2009

(30) Foreign Application Priority Data

Sep. 3, 2007 (DE) ..... 10 2007 041 829

(51) Int. Cl.
*H05G 2/00* (2006.01)

(52) U.S. Cl. ..... 378/119

(58) Field of Classification Search ..... 378/119
See application file for complete search history.

(56) References Cited

U.S. PATENT DOCUMENTS 4,606,061 A * 8/1986 Ramamurti ..... 378/119
4,832,433 A 5/1989 De La Chapelle et al.
5,010,562 A * 4/1991 Hernandez et al. ..... 378/125
6,760,402 B2 * 7/2004 Ghelmansarai ..... 378/65
6,908,355 B2 * 6/2005 Habib et al. ..... 445/50
7,333,588 B2 * 2/2008 Mistretta et al. ..... 378/10
2006/0098783 A1 * 5/2006 Dunham et al. ..... 378/122
2006/0193439 A1 * 8/2006 Anno et al. ..... 378/130

FOREIGN PATENT DOCUMENTS

DE 38 32 117 3/1989
DE 102005052131 5/2007
EP 298098 B1 * 3/1994
JP 8-167360 6/1996

* cited by examiner

*Primary Examiner*—Chih-Cheng G Kao
(74) *Attorney, Agent, or Firm*—Schiff Hardin LLP

(57) ABSTRACT

An electron source has an electron emitter, an anode, a voltage source connected between the electron emitter and the anode, as well as a switch connected with the electron emitter. The switch is fashioned as a optoelectronic switching element.

7 Claims, 1 Drawing Sheet

ELECTRON SOURCE

BACKGROUND OF THE INVENTION

1. Field of the Invention

The present invention concerns an electron source as well as an x-ray apparatus embodying such an electron source.

2. Description of the Prior Art

A device to generate x-rays which has an electron source with at least one carbon nanotube is known from DE 10 2005 052 131 A1. The carbon nanotube is arranged in a recess with conductive substrate. A desired radiation power with comparably slight electrical circuit complexity should therefore be reliably and reproducibly set and can be stably maintained.

SUMMARY OF THE INVENTION

An object of the present invention is to further develop such an electron source suitable for an x-ray apparatus with regard to the switching capability relative to the prior art.

This object is achieved according to the invention by an electron source having an electron emitter, an anode, a voltage source connected between the electron emitter and the anode, as well as a switch connected with the electron emitter and provided to activate and deactivate the electron source, which switch is fashioned as an optoelectronic switching element. As used herein, an optoelectronic switching element encompasses any switching element that enables the switching of an electrical current by means of an optical signal. This can advantageously be a plasma switch. A switch operating with a plasma is known in principle from EP 0 298 098 B1, for example. Another switch that, upon actuation, generates a plasma that enables an electrical current flow, is disclosed in JP 08167360 A.

In a preferred embodiment, the plasma switch is arranged within an evacuated volume of the electron source. Since no electrical signals are required to trigger the switching processes, no electrical signal lines need to be directed through the wall of the vacuum container. Rather, it is sufficient for the vacuum container to have a light-conducting element. If only a single, optically-operable switch is located in the vacuum container, the light-conducting element can be realized as an optical fiber, for example.

If multiple optical-operable switches are arranged in the vacuum container of the electron source (as provided according to a preferred development), a window integrated into the wall of the vacuum container is advantageously used as a light-conductive element. This has the advantage that a hermetic sealing of the vacuum container can be ensured in a simple manner. Moreover, the targeted activation of a specific switch or specific switches is provided very simply by at least one light beam, as an optical signal, being conducted through the window at a defined point.

The optically-operable switches (in particular plasma switches) connected in the current fed to a respective electron emitter can be arranged immediately behind the window so that they are struck by the appertaining light beam without additional elements influencing the beam path. Alternatively, it is possible (for example) to conduct the optical signals to the optoelectronic switching elements with the aid of optical fibers arranged in the vacuum container.

A light source to generate the optical signals required to activate the optoelectronic switching elements is advantageously a component of the device according to the invention. A laser is in particular suitable as a light source. A single laser in cooperation with a multiplexer is hereby sufficient to activate a plurality of optoelectronic switching elements. In general, an arbitrary deflector can be used in order to conduct an optical signal in a targeted manner to a specific switching element.

In an advantageous embodiment, the electron source has an electron emitter with carbon nanotubes that require no electrical power for heating. Moreover, emitters with carbon nanotubes have the advantage that multiple emitters can be arranged within an x-ray tube in a simple manner. This affords wide-ranging possibilities to replace movable machine parts of an x-ray system (in particular a computer tomography system) with stationary machine parts.

An advantage of the invention is that a rapidly switchable electron source that has no electrical signal lines directed through the wall of a vacuum container can be provided due to the optoelectronic activation and deactivation of an electron emitter.

DESCRIPTION OF THE PREFERRED EMBODIMENTS

Figure 1:
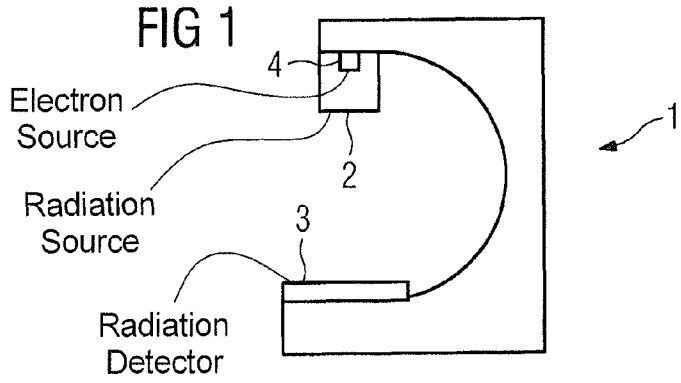
FIG. 1 schematically illustrates an x-ray apparatus.

Parts corresponding to one another or achieving substantially the same result are labeled with the same reference characters in all figures.

FIG. 1 is a schematic representation an x-ray apparatus 1 with a radiation source 2 emitting x-ray radiation and a radiation detector 3, for example a semiconductor detector. An electron source 4 is indicated as the single detail of the radiation source 2. The x-ray apparatus 1 can be used for medical diagnosis or therapy apparatus, for example, or for nondestructive materials testing.

Figure 2:
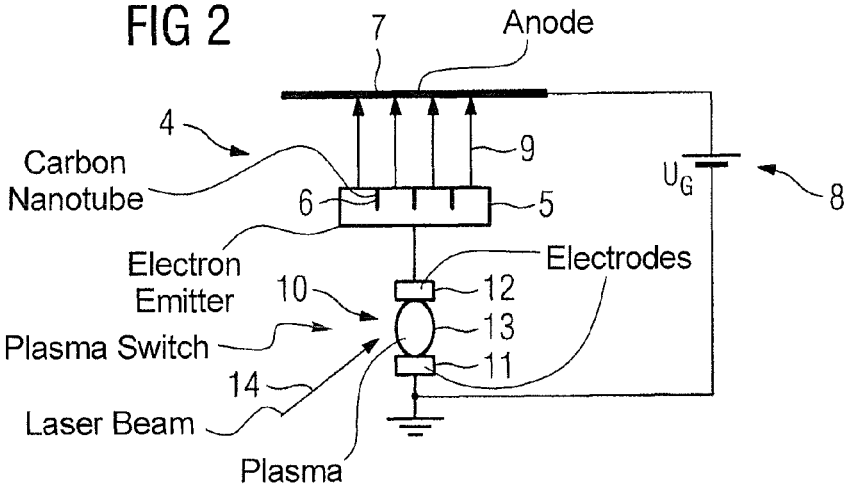
FIG. 2 shows a first embodiment of an electron source of the x-ray apparatus according to FIG. 1.

A first embodiment of an electron source 4 suitable for the x-ray apparatus 1 comprises a single electron emitter 5 that has a number of carbon nanotubes 6 (only symbolically indicated in FIG. 2). Due to the carbon nanotubes 6, the electron emitter 5 is in the position to emit electrons without heating. The electron emitter 5 operating with carbon nanotubes 6 can be switched very rapidly. Switching times on the order of 100 ns can be realized at typical voltages of 2 kV.

An anode 7 in the form of a screen (grid) is located at a distance of a few 100 μm from the electron emitter 5. A screen voltage $U_G$ can be applied between the electron emitter 5 and the anode 7 by means of a voltage source 8. Electrons 9 escaping from the electron emitter 5 are illustrated in FIG. 2 by a number of parallel arrows.

A switch 10 is provided to switch the screen voltage $U_G$. The switch 10 is connected at one side with the electron emitter 5 and at the other side to ground potential. As long as the switch 10 is electrically non-conductive, the electron emitter 5 (also designated as a field emitter) is located at a potential which approximately corresponds to the screen voltage $U_G$. In this state, no electrons 9 are emitted due to field emission. If the switch 10 is closed, the electron emitter 5 is drawn at least approximately to ground potential, such that at least approximately the full screen voltage $U_G$ of a few kV is presented between the electron emitter 5 (also designated as an emitter for short) and the screen 7, whereupon the electron source 4 releases electrons 9, meaning that the radiation source 2 is in operation.

The switch 10 is fashioned as a plasma switch, wherein the approximate spatial expansion of a plasma 13 formed between two electrodes 11, 12 is visible in FIG. 2. The plasma 13 which produces an electrically conductive connection between the electrodes 11, 12 (and therefore closes the switch 10) is generated by a laser beam 14 as an optical signal directed onto the switch 10. In principle, the optical signal 14 can be generated by an arbitrary light source. The plasma switch 10 is located within a vacuum vessel (not recognizable in FIG. 2) together with the electron emitter 5 and the grid 7.

Figure 3:
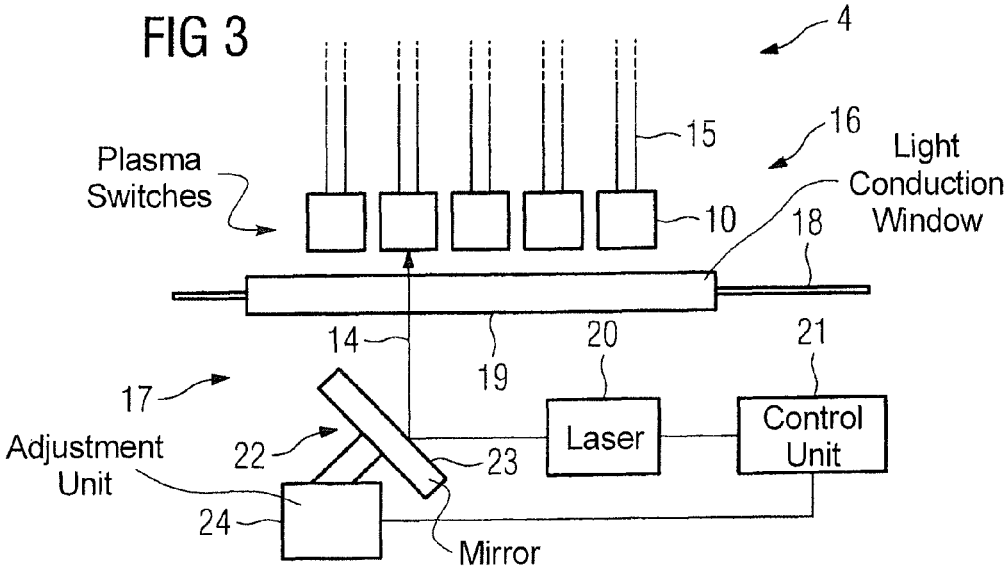
FIG. 3 shows a second embodiment of an electron source of the x-ray apparatus according to FIG. 1.

The embodiment according to FIG. 3 conforms with the embodiment according to FIG. 2 in terms of the basic mode of operation, but multiple plasma switches 10 that are connected via contacts 15 with a respective electron emitter 5 (not shown in FIG. 3) are present instead of a single plasma switch 10. A vacuum container 16 in which the respective electron sources 4 comprising a plasma switch 10 and an electron emitter 5 are located is separated from an external space 17 by a wall 18.

A window 19 as a light-conducting element is integrated into the wall 18. The single window 19 is sufficiently dimensioned in order to be able to feed optical signals 14 to each of the switches 10 which, in the exemplary embodiment according to FIG. 3, are arranged directly behind the window 19. Alternatively, light-conducting elements, for example optical fiber bundles (not shown), could also be arranged between the window 19 and the individual plasma switches 10. In each case, the optical signals 14 are generated by means of a laser 20 as a light source provided to activate the optoelectronic switching elements 10. The arrangement shown in FIG. 3 with a number of optoelectronic switches 10 positioned in an array is also designated as a multi-channel plasma switch.

The laser 20 has a minimal power of 20 mW and a repetition rate of more than 10 KHz and is connected with a control unit 21 which, like the laser 20, is located in the external space 17. A deflector 22 is likewise arranged in the external space 17, which deflector 22 is provided to direct the laser beam 14 generated by the laser 20 to a specific plasma switch 10 in a targeted manner. The deflector 22 comprises a mirror 23 which is movably linked to an adjustment unit 24. The adjustment unit 24 is connected in terms of data with the control unit 21 and can operate with piezoceramic adjustment elements, for example. Instead of the deflector 22 possessing one movable mirror 23, a multiplexer can also be used, for example. In each case, the deflector 22 or any other switching unit fulfilling its purpose (i.e. influencing the beam path of the optical signals 14) is arranged outside of the vacuum container 16, such that there is no necessity to direct corresponding conductors through the wall 18 by means of vacuum ducts.

Beyond avoiding potential leak points, the omission of vacuum ducts has the advantage that no solder is required which would otherwise be necessary to connect electrical conductors directed through the wall with typical ceramic insulation materials. The temperature limitations that are inevitably present given use of solder are therefore also done away with. The fact that no electrical signals but rather exclusively optical signals 14 are conducted through the wall 18 also means that no insulation separations (in particular relevant in the high voltage range above 2 kV) are to be attended to. Particularly given a plurality of switches 10, their activation by means of optical signals 14 therefore enables a significantly more compact design of the radiation source 2 than given electrical activation of individual switches connected with the emitters 5.

In principle, it would also be possible to connect the voltage present at the screen 7 (i.e. at the anode) instead of the voltage present at the at least one emitter 5. However, limitations with regard to the stability of the operation and the achievable switching times would thereby have to be accepted due to higher capacitances. In contrast to this, the association of a respective individual plasma switch 10 with an emitter 5 as is provided in both exemplary embodiments has the advantage that the plasma current generated in the switch 10 is used without interconnection of additional electrical elements in order to transport electrons to the emitter 5 and there to enable the emission of electrons 9. Switching processes with extremely little time lag thus can therefore be realized.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electron source comprising:

an electron emitter that emits electrons therefrom;

an anode;

a voltage source connected between the electron emitter and the anode that generates a voltage that accelerates said electrons emitted by said electron emitter toward said anode;

a plasma switch connected to said electron emitter that is operable to activate and deactivate emission of said electrons by said electron emitter, said plasma switch being formed as an opto-electronic switching element; and a vacuum enclosure in which said plasma switch is contained, said vacuum enclosure having an enclosure wall with a light-conducting element therein allowing light to reach said plasma switch in said vacuum enclosure.

2. An electron source as claimed in claim 1 wherein said electron emitter is comprised of carbon nanotubes.

3. An electron source as claimed in claim 1 comprising a light source that emits light that operates said opto-electronic switching element to switch said opto-electronic switching element.

4. An electron source as claimed in claim 3 wherein said light source is a laser.

5. An electron source as claimed in claim 4 comprising a deflector that deflects a laser beam emitted by said laser onto said opto-electronic switching element.

6. An electron source as claimed in claim 1 wherein said opto-electronic switching element is a first opto-electronic switching element, and wherein said electron source comprises a plurality of additional opto-electronic switching elements all connected with said electron source.

7. An x-ray apparatus comprising:

an x-ray source that emits x rays;

a radiation detector on which said x-rays are incident; and said x-ray source comprising an electron source comprising an electron emitter that emits electrons therefrom, an anode, a voltage source connected between the electron emitter and the anode that generates a voltage that accelerates said electrons emitted by said electron emitter toward said anode, and a plasma switch connected to said electron emitter that is operable to activate and deactivate emission of said electrons by said electron emitter, said plasma switch being formed as an opto-electronic switching element; and a vacuum enclosure in which said plasma switch is contained, said vacuum enclosure having an enclosure wall with a light-conducting element therein allowing light to reach said plasma switch in said vacuum enclosure.

* * * * *